US008514257B2

(12) United States Patent
Law et al.

(10) Patent No.: US 8,514,257 B2
(45) **Date of Patent: *Aug. 20, 2013**

(54) GENERATION OF DIGITAL ELECTROSTATIC LATENT IMAGES UTILIZING WIRELESS COMMUNICATIONS

(75) Inventors: Kock-Yee Law, Penfield, NY (US); Mandakini Kanugo, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 305 days.

This patent is subject to a terminal disclaimer.

(21) Appl. No.: 13/008,802

(22) Filed: Jan. 18, 2011

(65) Prior Publication Data

US 2012/0183307 A1 Jul. 19, 2012

(51) Int. Cl.
*B41J 2/415* (2006.01)

(52) U.S. Cl.
USPC ..... 347/128

(58) Field of Classification Search
CPC ..... B41J 2/41; G03G 5/047
USPC ..... 347/112, 128, 141; 399/8
See application file for complete search history.

(56) References Cited

U.S. PATENT DOCUMENTS

| | | | |
|---|---|---|---|
| 3,121,006 | A | 2/1964 | Middleton et al. |
| 4,464,450 | A | 8/1984 | Teuscher |
| 4,921,773 | A | 5/1990 | Melnyk et al. |
| 6,100,909 | A | 8/2000 | Haas et al. |

*Primary Examiner* — An Do
(74) *Attorney, Agent, or Firm* — Pillsbury Winthrop Shaw Pittman LLP

(57) ABSTRACT

An electrostatic latent image is formed when the print controller of a print engine wirelessly transmits digital printing signals. Driving electronics receives the wirelessly transmitted digital printing signals and transmits digital signals to address plurality of thin-film transistors (TFTs) individually in a TFT array. Driving electronics also transmit pixel voltages to bias individual TFTs in the TFT array which in turn drives the hole injecting pixels overcoated with a charge transport layer to generate the electrostatic latent image on the surface of the charge transport layer in response to the received digital printing signals.

24 Claims, 6 Drawing Sheets

GENERATION OF DIGITAL ELECTROSTATIC LATENT IMAGES UTILIZING WIRELESS COMMUNICATIONS

CROSS REFERENCE TO RELATED APPLICATIONS

Reference is made to commonly owned and co-pending, U.S. patent application Ser. No. 12/539,397 to Law et al., entitled Digital Electrostatic Latent Image Generating Member and U.S. patent application Ser. No. 12/539,557 to Kanungo et al., Digital Electrostatic Latent Image Generator, the entire disclosures of which are incorporated herein by reference in its entirety.

BACKGROUND

The presently disclosed embodiments relates to a data communication system to be utilized in a direct digital marking (printing) system, namely utilizing wireless communications to transfer millions of bits of data between a print engine and a novel imaging member.

There are two conventional color printing technology platforms, i.e., inkjet and xerography, and other new color printing technology platform, i.e., digital flexo or digital offset printing. Each of these color printing technology platforms have highly complex print systems, which leads to complicated print processes, high box (device) cost, and high print run cost.

New advances in nanotechnology and display technology have led to the development/discovery that a digital electric field can be created utilizing an electric field induced hole injection reaction between a patternable hole injection nanomaterial and the Xerox charge (hole) transport layer. For example, in application Ser. Nos. 12/539,397 and 12/539,557, entitled Digital Electrostatic Latent Image Generator, and entitled Digital Electrostatic Latent Image Generating Member, Carbon Nanotube (CNT) and PEDOT were found to inject holes efficiently to the Xerox charge transport layer (CTL, TPD in polycarbonate) under the influence of an electric field. CNT and PEDOT are patternable using nanofabrication techniques and thus pixels can be made in the micron dimension. When these pixels are overcoated with the TPD CTL, digital latent images may be created and these pixels may be integrated into the appropriate backplane technology to fully digitize the printing system.

In addition, in a xerographic development system, latent image generation, and toner development can also occur without using the conventional combination of the ROS/Laser and charger thus simplifying the generation of latent electrostatic images compared to xerography. This has been discussed in application Ser. No. 12/869,605, entitled "Direct Digital Marking Systems." Illustratively, a bilayer device comprising a PEDOT hole injection layer and the TPD CTL may be mounted an OPC drum in the CRU. The drum was rotated through the development nip and a toner image was observed in the post-development region. As the bilayer member first contacted the magnetic brush, the bias on the magnetic brush induced a hole injection reaction to create the electrostatic latent image on the CTL surface of the bilayer. This was followed by toner development before the bilayer member exited the development nip. This two step process was accomplished within the development nip, resulting in direct toner printing without laser/ROS, charger or photoreceptor. The permanent image may be obtained by transferring the toned image to paper following fusing.

This nano image marker and the direct digital printing process can also be extended to print with flexo ink, offset ink and liquid toner, as is discussed in application Ser. No. 12/854,526, entitled "Electrostatic Digital Offset/Flexo Printing." Thus, the new direct printing concept may be regarded as a potential new digital printing platform.

U.S. Pat. No. 6,100,909 (to inventors Hass and Kubby) describes an apparatus for forming an imaging member. The apparatus includes an array of high voltage thin-film transistors (TFT) and capacitors. A latent image is formed by applying DC bias to each TFT using a High Voltage Power Supply and charged-area detection (CAD)-type development. FIG. 1 illustrates an array of thin film transistors in the apparatus for forming an imaging member. The array 10 is arranged in a rectangular matrix of 5 rows and 5 columns. Although only five rows and columns are illustrated, in embodiments of the invention located in devices that print or image on an 8.5 inch by 11-inch array having a 600 dpi resolution, the array will have about $3\times10^5$ transistors which would correspond to $3\times10^5$ million pixel cells. In addition, for 1200 dpi resolution, the array would have $7\times10^5$ transistors and $7\times10^5$ pixel cells.

The array 10 when coupled to a bilayer imaging member consisting of hole injection pixels overcoated with a hole transport layer generates latent images from digital information supplied by a computer 44 (e.g., a print engine) to a controller 42. The controller 42 may be referred to as a digital front end ("DFE"). The computer supplies digital signals to a controller 42 (or DFE), which decomposes the digital signals into bits in the utilized color space (e.g., the CMYK or the RGB color space). The bits represent different colors with different intensities that the printer utilizes to print the image. The controller 42 directs the operation of the array 10 through a plurality of interface devices including a decoder 12, a refresh circuit 18, and a digital-to-analog (D/A) converter 16.

In contrast to other active matrix products (such as a television or monitor), which are static, the new nano imaging member (whether connected to or part of a belt or drum) is expected to be moving during the printing process. Millions of bits will need to be transmitted to the moving imaging member to create the digital electric field. Thus, a serious challenge arises to commutate the backplane with the driving electronic while the belts (or drum) are moving. While the belt or drum is moving, millions of bits and also electric current are being supplied to the backplane.

Accordingly, there is an unmet need for systems and/or methods that provide the large amount of data and/or electric current to the moving nano imaging member in a printing device in an accurate and cost-effective manner.

SUMMARY

According to embodiments illustrated herein, systems and methods are described that utilize Wireless Display ("WiDi") technology to commutate between the print engine, the driving electronics and the nano imaging member. More specifically, WiDi antennas/receivers are incorporated into the driving electronic of the nano imaging marker and receive signals transmitted from the computer or print engine through the controller (or digital front end). In a modern color printer, a computer is utilized to create the digital file. The digital file is sent to the controller (digital front end), where the digital print files is decomposed into CMYK or RBG bits. The controller sends the digital bits to the antenna/receiver wirelessly utilizing WiDi technology. The received wireless digital signals are then sent to the driving electronics which transfers the digital signals to the TFTs of the moving nano imaging member. The signals and voltages received by the TFTs will induce hole injection in the hole injection pixels of the bilayer imaging member and create a digital electric field. The digital electric field creates a latent image and printing is performed without a wired connection between the controller and driving electronics. Latent images are then printed (or developed) depending on the subsequent marking technology. In embodiments of the invention, the nano imaging member can be divided into a plurality of data zones depending on a printing speed of the device.

In particular, the present embodiments provide a method of forming an electrostatic latent image including receiving wirelessly transmitted digital printing signals from the print controller of a print engine, transmitting driving signals to address multitude of thin-film transistors (TFTs) individually in a backplane in response to the received digital printing signals; and transmitting pixel voltages to bias individual TFTs in the backplane to generate the electrostatic latent image in response to the received digital printing signals. The received digital signals may be transmitted according to the WiDi wireless protocol. In addition, the embodiments further provide receiving the electrostatic latent image at the development subsystem and converting the electrostatic latent image into a toned image. The embodiments also provide receiving the toned image, transferring the toned image onto a media, and fixing the toned image onto the media.

In further embodiments, there is provided an apparatus for printing a latent image including a receiver configured to receive wirelessly transmitted digital signals from a controller and to generate selection signals and digital pixel voltages; driving electronics configured to receive the selection signals and the digital pixel voltages and to generate bias signals and pixel voltages; and a plurality of thin-film transistors (TFTs) arranged in a backplane to receive the bias signals and the pixel voltages, wherein the TFTs drive the hole injection pixels to generate an electrostatic latent image in response to the bias signals and pixel voltages. The further embodiments may include an antenna configured to receive the wirelessly transmitted signals from the controller and to transfer the received digital signals to the receiver. The receiver may be a wireless display protocol (WiDi) receiver. In the further embodiments, the backplane is divided into a plurality of zones and each of the plurality of zones includes a corresponding receiver to receive the wirelessly transmitted digital signals from the controller of the print engine and to generate corresponding selection signals and digital pixel voltages. Alternatively, the backplane is divided into a plurality of zones and one of the plurality of zones includes the receiver and wherein the receiver transfers the received selection signals and digital pixel voltages to a selected zone of the plurality of zones.

BRIEF DESCRIPTION OF THE DRAWINGS

For a better understanding of the present embodiments, reference may be had to the accompanying figures.

FIG. 3(*b*) illustrates an embodiment of a nano digital direct printing system according to an embodiment;

FIG. 3(*c*) presents a cross section view of a nano imaging member according to an embodiment;

FIG. 3(*d*) presents a top view of the nano imaging member according to an embodiment.

DETAILED DESCRIPTION

In the following description, it is understood that other embodiments may be utilized and structural and operational changes may be made without departure from the scope of the present embodiments disclosed herein.

Figure 1:
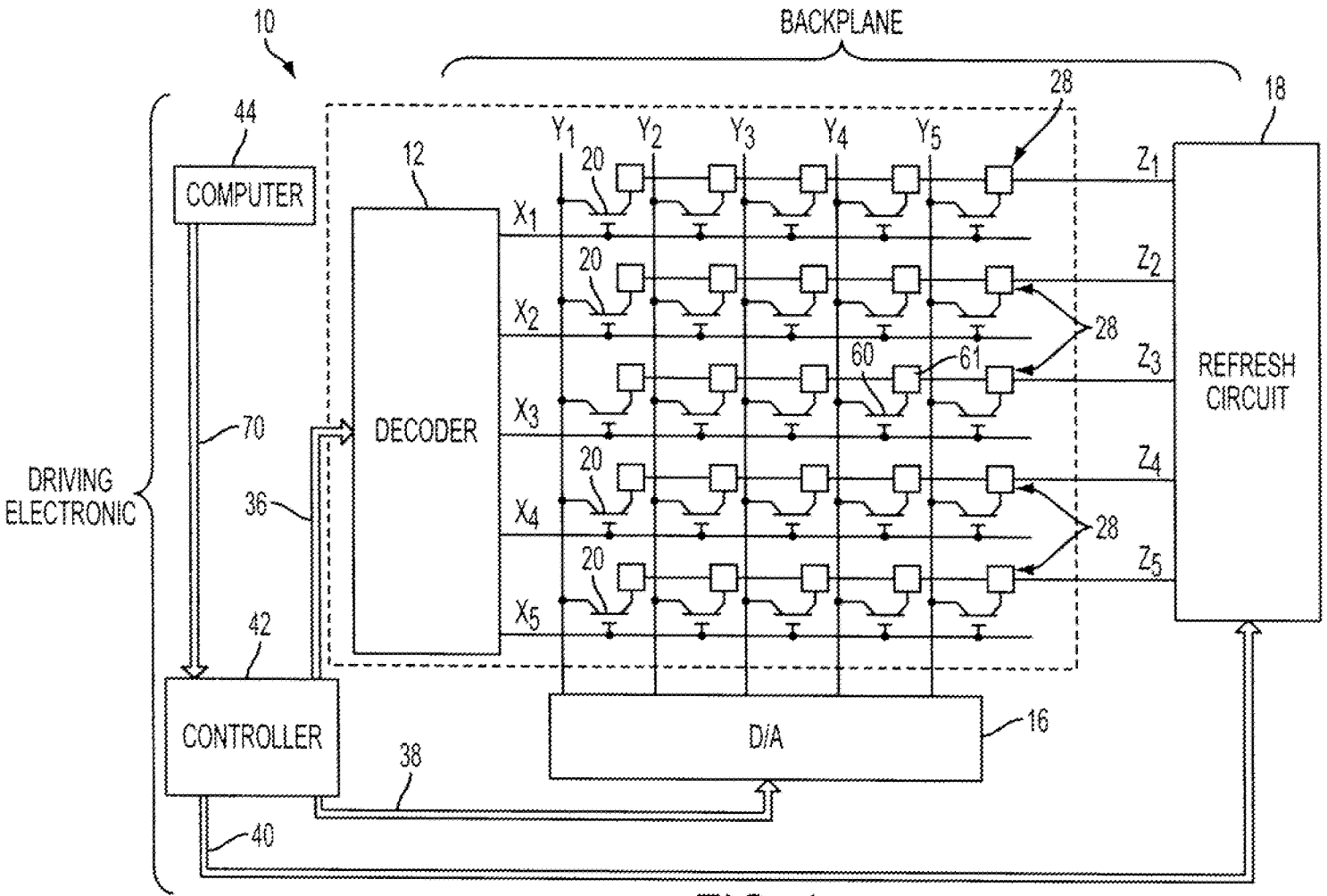
FIG. 1 illustrates an array of thin film transistors in the apparatus for forming an imaging member according to the prior art.
Figure 2:
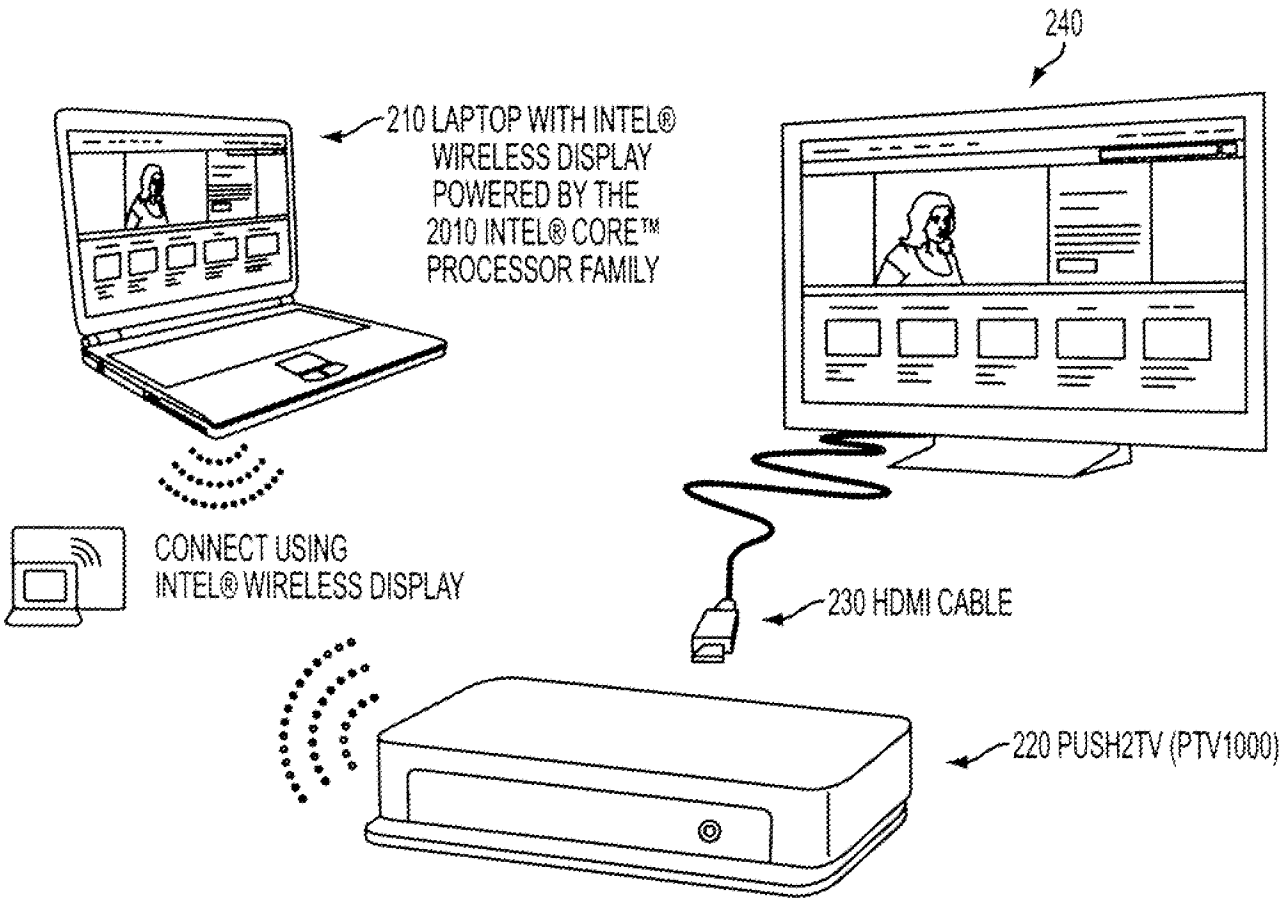
FIG. 2 illustrates a television system incorporating WiDi technology.
Figure 3A:
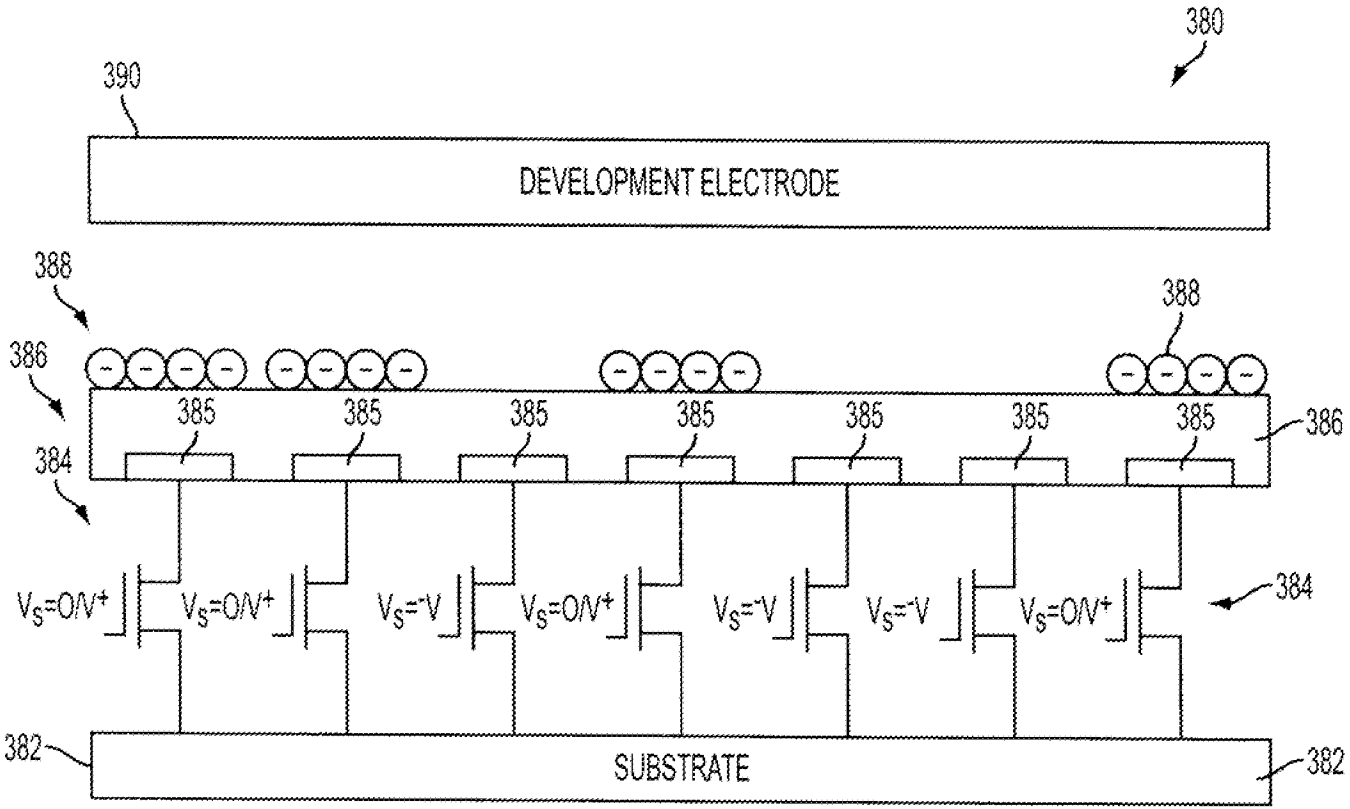
FIG. 3(*a*) illustrates operation of a latent imaging forming apparatus according to an embodiment.
Figure 3B:
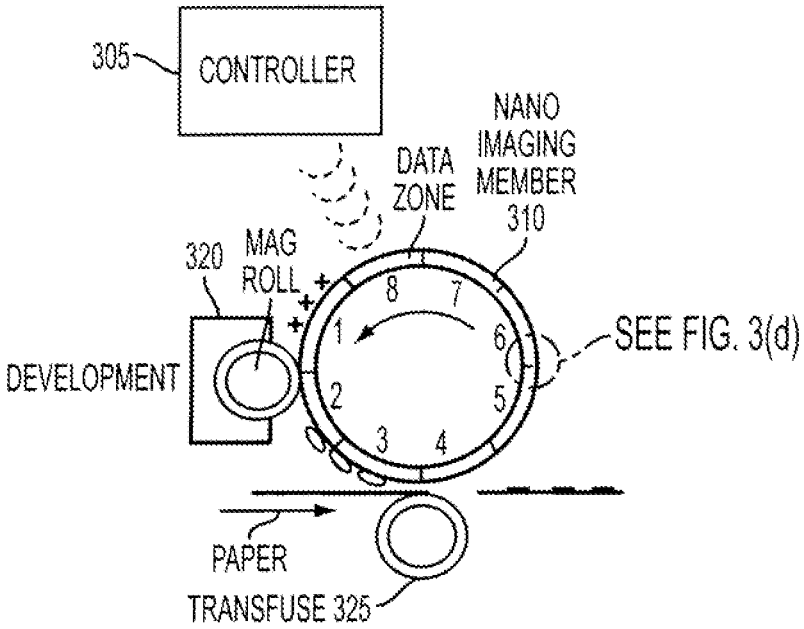
Figure 3C:
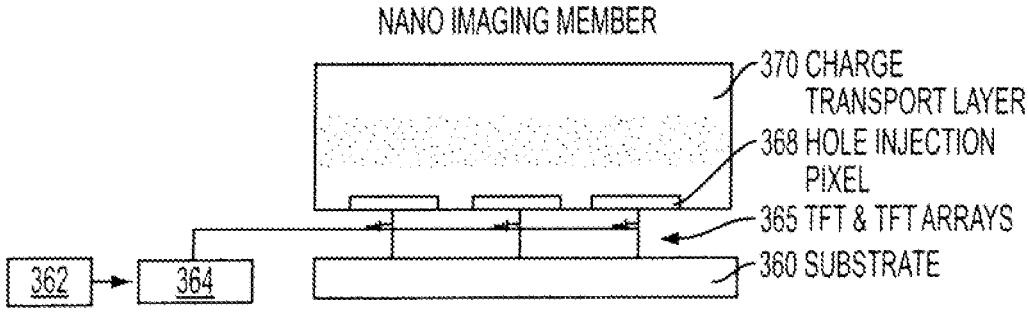
Figure 3D:
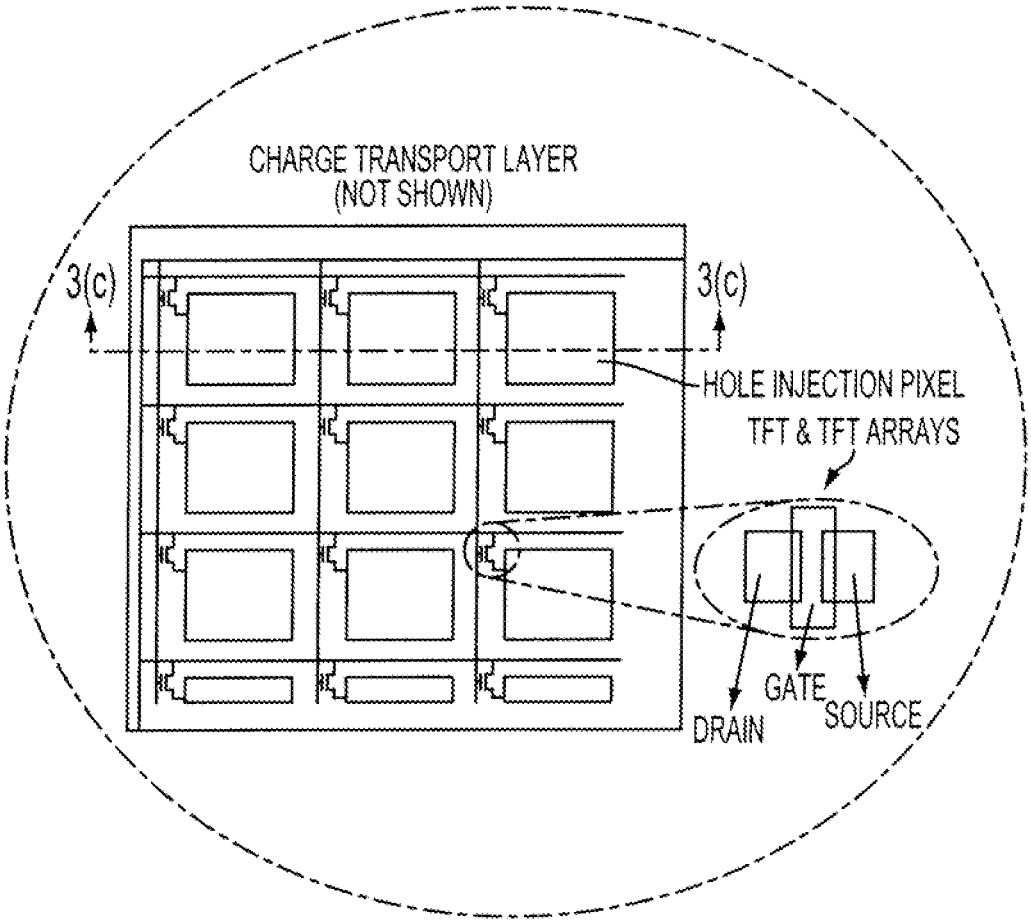

In early 2010, Intel Corporation introduced Wireless Display ("WiDi") technology. WiDi enables laptop users to transmit display signals (e.g., video signals) wirelessly to a television ("TV") and watch the transmitted video in real time on the TV with little additional cost. FIG. 2 illustrates a television system incorporating WiDi technology. The system includes a laptop 210 including WiDi capability, a television WiDi adapter 220, a HDMI cable 230 and a television 240. The laptop 210 pushes (or transmits), via a wireless transmission, what is being displayed on the laptop screen to the television adapter 220. The television adapter 220 may be a Netgear Push2TV adapter. The television adapter 220 transmits the received signals (which correspond to the laptop display) to the television 240 via the HDMI cable 230. Thus, the laptop display information is transmitted to your television without having cables stretch across the room.

In the present embodiment, systems and methods are described that utilize wireless communications to communicate data within a printing device. In the printing device, the controller transmits data wirelessly to the driving electronics in the nano imaging member. In embodiments, the wireless communication protocol utilized in the printing device is the WiDi protocol. Wireless antennas/receivers may be incorporated into the driving electronics of the nano imaging member. Illustratively, WiDi antennas/receivers may be incorporated into the driving electronic of the nano imaging marker to receive the wirelessly transmitted digital signals.

The computer (or print engine) sends the print file to the controller (or DFE), which will convert the print file to CMYK or RGB digital bits so the printer can print an image corresponding to the print file. The controller (or DFE) wirelessly transmits the CMYK or RGB digital bits to the antennas/receivers. The antenna can be part of the driving electronics for the nano imaging member or can be coupled to the driving electronics for the nano imaging member. The digital signals received are then used to run the thin-field transistor (TFT) array and create a digital electric field within the nano imaging member. The digital electric field creates a latent image. Latent images are then printed (or developed) depending on the subsequent marking technology.

In further embodiments, the nano imaging member can be divided into a plurality of data zones depending on a printing speed or the design of the printing device. Each data zone on the nano imaging member may have an integrated antenna/receiver. In further embodiments, the nano imaging member may have only one antenna/receiver as part of the driving electronic. The antenna/receiver receives the wirelessly transmitted digital signals from the controller and distributes the received digital signals to the selected data zone.

FIG. 3(*a*) illustrates operation of a latent imaging forming apparatus 380 using a nano imaging member. The latent imaging forming apparatus includes an array of hole injection pixels 385 over the substrate 382. The hole injection pixels are coupled to a TFT backplane comprising a plurality of TFTs 384 for addressing the individual pixels. The nano imaging member further includes a charge transport layer 386 disposed over the array of hole injecting pixels. The charge transport layer 386 can be configured to transport holes provided by the one or more pixels 385 to create electrostatic charge contrast required for printing.

In various embodiments, each pixel 385 of the array can include a layer of nano-carbon materials. In other embodiments, each pixel 385 of the array can include a layer of organic conjugated polymers. Yet in some other embodiments, each pixel 385 of the array can include a layer of a mixture of nano-carbon materials and organic conjugated polymers including, for example, nano-carbon materials dispersed in one or more organic conjugated polymers. In certain embodiments, the surface resistivity of the layer including the one or more of nano-carbon materials and/or organic conjugated polymers can be from about 50 ohm/sq to about 10,000 ohm/sq or from about 100 ohm/sq. to about 5,000 ohm/sq or from about 120 ohm/sq. to about 2,500 ohm/sq. The nano-carbon materials and the organic conjugated polymers can act as the hole-injection materials for the electrostatic generation of latent images. One of the advantages of using nano-carbon materials and the organic conjugated polymers as hole injection materials is that they can be patterned by various fabrication techniques, such as, for example, photolithography, inkjet printing, screen printing, transfer printing, and the like.

Hole-Injecting Pixels Including Nano-Carbon Materials. As used herein, the phrase "nano-carbon material" refers to a carbon-containing material having at least one dimension on the order of nanometers, for example, less than about 1000 nm. In embodiments, the nano-carbon material can include, for example, nanotubes including single-wall carbon nanotubes (SWNT), double-wall carbon nanotubes (DWNT), and multi-wall carbon nanotubes (MWNT); functionalized carbon nanotubes; and/or graphenes and functionalized graphenes, wherein graphene is a single planar sheet of $sp^2$-hybridized bonded carbon atoms that are densely packed in a honeycomb crystal lattice and is exactly one atom in thickness with each atom being a surface atom.

Carbon nanotubes, for example, as-synthesized carbon nanotubes after purification, can be a mixture of carbon nanotubes structurally with respect to number of walls, diameter, length, chirality, and/or defect rate. For example, chirality may dictate whether the carbon nanotube is metallic or semiconductive. Metallic carbon nanotubes can be about 33% metallic. Carbon nanotubes can have a diameter ranging from about 0.1 nm to about 100 nm, or from about 0.5 nm to about 50 nm, or from about 1.0 nm to about 10 nm; and can have a length ranging from about 10 nm to about 5 mm, or from about 200 nm to about 10 μm, or from about 500 nm to about 1000 nm. In certain embodiments, the concentration of carbon nanotubes in the layer including one or more nano-carbon materials can be from about 0.5 weight % to about 99 weight %, or from about 50 weight % to about 99 weight %, or from about 90 weight % to about 99 weight %. In embodiments, the carbon nanotubes can be mixed with a binder material to form the layer of one or more nano-carbon materials. The binder material can include any binder polymers as known to one of ordinary skill in the art.

In various embodiments, the layer of nano-carbon material (s) in each pixel 385 of the pixel array can include a solvent-containing coatable carbon nanotube layer. The solvent-containing coatable carbon nanotube layer can be coated from an aqueous dispersion or an alcohol dispersion of carbon nanotubes wherein the carbon nanotubes can be stabilized by a surfactant, a DNA or a polymeric material. In other embodiments, the layer of carbon nanotubes can include a carbon nanotube composite including, but not limited to, carbon nanotube polymer composite and/or carbon nanotube filled resin. In embodiments, the layer of nano-carbon material(s) can be thin and have a thickness ranging from about 1 nm to about 1 μm, or from about 50 nm to about 500 nm, or from about 5 nm to about 100 nm.

Hole-Injecting Pixels Including Organic Conjugated Polymers—In various embodiments, the layer of organic conjugated polymers in each pixel 385 can include any suitable material, for example, conjugated polymers based on ethylenedioxythiophene (EDOT) or based on its derivatives. The conjugated polymers can include, but are not limited to, poly (3,4-ethylenedioxythiophene) (PEDOT), alkyl substituted EDOT, phenyl substituted EDOT, dimethyl substituted polypropylenedioxythiophene, cyanobiphenyl substituted 3,4-ethylenedioxythiopene (EDOT), teradecyl substituted PEDOT, dibenzyl substituted PEDOT, an ionic group substituted PEDOT, such as, sulfonate substituted PEDOT, a dendron substituted PEDOT, such as, dendronized poly(paraphenylene), and the like, and mixtures thereof. In further embodiments, the organic conjugated polymer can be a complex including PEDOT and, for example, polystyrene sulfonic acid (PSS). The molecular structure of the PEDOT-PSS complex can be shown as the following:

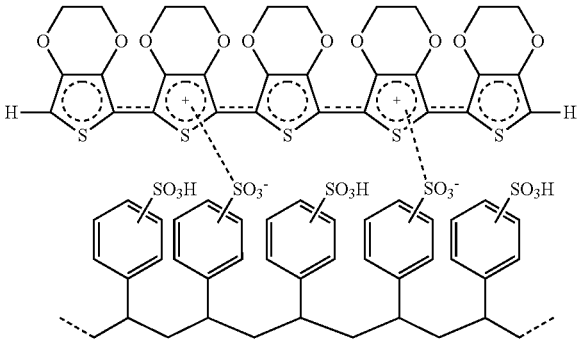

The exemplary PEDOT-PSS complex can be obtained through the polymerization of EDOT in the presence of the template polymer PSS. The conductivity of the layer containing the PEDOT-PSS complex can be controlled, e.g., enhanced, by adding compounds with two or more polar groups, such as for example, ethylene glycol, into an aqueous solution of PEDOT-PSS. As discussed in the thesis of Alexander M. Nardes, entitled "On the Conductivity of PEDOT-PSS Thin Films," 2007, Chapter 2, Eindhoven University of Technology, which is hereby incorporated by reference in its entirety, such an additive can induce conformational changes in the PEDOT chains of the PEDOT-PSS complex. The conductivity of PEDOT can also be adjusted during the oxidation step. Aqueous dispersions of PEDOT-PSS are commercially available as BAYTRON P® from H. C. Starck, Inc. (Boston, Mass.). PEDOT-PSS films coated on Mylar are commercially available in Orgacon™ films (Agfa-Gevaert Group, Mortsel, Belgium). PEDOT may also be obtained through chemical polymerization, for example, by using electrochemical oxidation of electron-rich EDOT-based monomers from aqueous or non-aqueous medium. Exemplary chemical polymerization of PEDOT can include those disclosed by Li Niu et al., entitled "Electrochemically Controlled Surface Morphology and Crystallinity in Poly(3,4-ethylenedioxythiophene) Films," Synthetic Metals, 2001, Vol. 122, 425-429; and by Mark Lefebvre et al., entitled "Chemical Synthesis, Characterization, and Electrochemical Studies of Poly(3,4-ethylenedioxythiophene)/Poly(styrene-4-sulfonate) Composites,"

Chemistry of Materials, 1999, Vol. 11, 262-268, which are hereby incorporated by reference in their entirety. As also discussed in the above references, the electrochemical synthesis of PEDOT can use a small amount of monomer, and a short polymerization time, and can yield electrode-supported and/or freestanding films.

In various embodiments, the array of pixels 385 can be formed by first forming a layer including nano-carbon materials and/or organic conjugated polymers over the substrate 382. Any suitable methods can be used to form this layer including, for example, dip coating, spray coating, spin coating, web coating, draw down coating, flow coating, and/or extrusion die coating. The layer including nano-carbon materials and/or organic conjugated polymers over the substrate 382 can then be patterned or otherwise treated to create an array of pixels 385. Suitable nano-fabrication techniques can be used to create the array of pixel 385 including, but not limited to, photolithographic etching, or direct patterning. For example, the materials can be directly patterned by nano-imprinting, inkjet printing and/or screen printing. As a result, each pixel of the array 385 can have at least one dimension, e.g., length or width, ranging from about 100 nm to about 500 μm, or from about 1 μm to about 250 μm, or from about 5 μm to about 150 μm.

Any suitable material can be used for the substrate 382 including, but not limited to, Aluminum, stainless steel, mylar, polyimide (PI), flexible stainless steel, poly(ethylene napthalate) (PEN), and flexible glass.

Charge Transport Layer—Referring back to FIG. 3(*a*), the nano-enabled imaging member 380 can also include the charge transport layer 386 configured to transport holes provided by the one or more pixels from the pixels array 385 to the surface 388 on an opposite side to the array of pixels. The charge transport layer 386 can include materials capable of transporting either holes or electrons through the charge transport layer 386 to selectively dissipate a surface charge. In certain embodiments, the charge transport layer 386 can include a charge-transporting small molecule dissolved or molecularly dispersed in an electrically inert polymer. In one embodiment, the charge-transporting small molecule can be dissolved in the electrically inert polymer to form a homogeneous phase with the polymer. In another embodiment, the charge-transporting small molecule can be molecularly dispersed in the polymer at a molecular scale. Any suitable charge transporting or electrically active small molecule can be employed in the charge transport layer 386. In embodiments, the charge transporting small molecule can include a monomer that allows free holes generated at the interface of the charge transport layer and the pixel to be transported across the charge transport layer 386 and to the surface 388. Exemplary charge-transporting small molecules can include, but are not limited to, pyrazolines such as, for example, 1-phenyl-3-(4'-diethylamino styryl)-5-(4"-diethylamino phenyl)pyrazoline; diamines such as, for example, N,N'-diphenyl-N,N'-bis(3-methylphenyl)-(1,1'-biphenyl)-4,4'-diamine (TPD); other arylamines like triphenyl amine, N,N,N',N'-tetra-p-tolyl-1,1'-biphenyl-4,4'-diamine (TM-TPD); hydrazones such as, for example, N-phenyl-N-methyl-3-(9-ethyl)carbazyl hydrazone and 4-diethyl amino benzaldehyde-1,2-diphenyl hydrazone; oxadiazoles such as, for example, 2,5-bis(4-N,N'-diethylaminophenyl)-1,2,4-oxadiazole; stilbenes; aryl amines; and the like. Exemplary aryl amines can have the following formulas/structures:

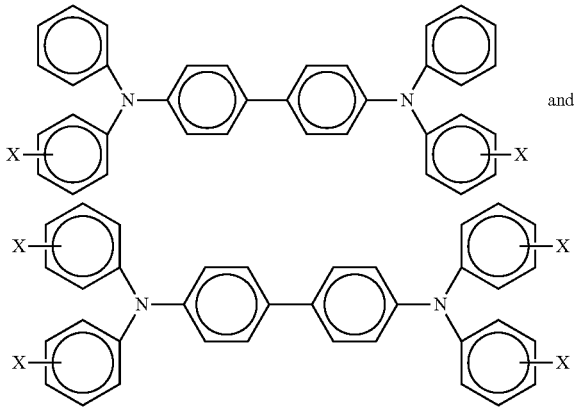

and wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

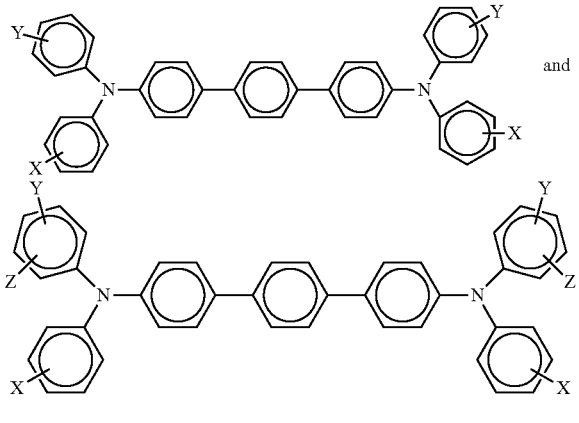

and wherein X, Y and Z are independently alkyl, alkoxy, aryl, a halogen, or mixtures thereof, and wherein at least one of Y and Z is present.

Alkyl and/or alkoxy groups can include, for example, from 1 to about 25 carbon atoms, or from 1 to about 18 carbon atoms, or from 1 to about 12 carbon atoms, such as methyl, ethyl, propyl, butyl, pentyl, and/or their corresponding alkoxides. Aryl group can include, e.g., from about 6 to about 36 carbon atoms of such as phenyl, and the like. Halogen can include chloride, bromide, iodide, and/or fluoride. Substituted alkyls, alkoxys, and aryls can also be used in accordance with various embodiments.

Examples of specific aryl amines that can be used for the charge transport layer 386 can include, but are not limited to, N,N'-diphenyl-N,N'-bis(alkylphenyl)-1,1'-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis- (2,5-dimethylphenyl)-[p-terphenyl]-4,4'-diamine, N,N'-diphenyl-N,N'-bis(3-chlorophenyl)-[p-terphenyl]-4,4"-diamine, and the like. Any other known charge transport layer molecules can be selected such as, those disclosed in U.S. Pat. Nos. 4,921,773 and 4,464,450, the disclosures of which are incorporated herein by reference in their entirety.

As indicated above, suitable electrically active small molecule charge transporting molecules or compounds can be dissolved or molecularly dispersed in electrically inactive polymeric film forming materials. If desired, the charge transport material in the charge transport layer 386 can include a polymeric charge transport material or a combination of a small molecule charge transport material and a polymeric charge transport material. Any suitable polymeric charge transport material can be used, including, but not limited to, poly (N-vinylcarbazole); poly(vinylpyrene); poly(-vinyltetraphene); poly(vinyltetracene) and/or poly(vinylperylene).

Any suitable electrically inert polymer can be employed in the charge transport layer 386. Typical electrically inert polymer can include polycarbonates, polyarylates, polystyrenes, acrylate polymers, vinyl polymers, cellulose polymers, polyesters, polysiloxanes, polyamides, polyurethanes, poly(cyclo olefins), polysulfones, and epoxies, and random or alternating copolymers thereof. However, any other suitable polymer can also be utilized in the charge transporting layer 386 such as those listed in U.S. Pat. No. 3,121,006, the disclosure of which is incorporated herein by reference in its entirety.

In various embodiments, the charge transport layer 386 can include optional one or more materials to improve lateral charge migration (LCM) resistance including, but not limited to, hindered phenolic antioxidants, such as, for example, tetrakis methylene(3,5-di-tert-butyl-4-hydroxy hydrocinnamate) methane (IRGANOX® 1010, available from Ciba Specialty Chemical, Tarrytown, N.Y.), butylated hydroxytoluene (BHT), and other hindered phenolic antioxidants including SUMILIZER™ BHT-R, MDP-S, BBM-S, WX-R, NW, BP-76, BP-101, GA-80, GM, and GS (available from Sumitomo Chemical America, Inc., New York, N.Y.), IRGANOX® 1035, 1076, 1098, 1135, 1141, 1222, 1330, 1425WL, 1520L, 245, 259, 3114, 3790, 5057, and 565 (available from Ciba Specialties Chemicals, Tarrytown, N.Y.), and ADEKA STAB™ AO-20, AO-30, AO-40, AO-50, AO-60, AO-70, AO-80, and AO-330 (available from Asahi Denka Co., Ltd.); hindered amine antioxidants such as SANOL™ LS-2626, LS-765, LS-770, and LS-744 (available from SANKYO CO., Ltd.), TINUVIN® 144 and 622LD (available from Ciba Specialties Chemicals, Tarrytown, N.Y.), MARK™ LA57, LA67, LA62, LA68, and LA63 (available from Amfine Chemical Corporation, Upper Saddle River, N.J.), and SUMILIZER® TPS (available from Sumitomo Chemical America, Inc., New York, N.Y.); thioether antioxidants such as SUMILIZER® TP-D (available from Sumitomo Chemical America, Inc., New York, N.Y.); phosphite antioxidants such as MARK™ 2112, PEP-8, PEP-24G, PEP-36, 329K, and HP-10 (available from Amfine Chemical Corporation, Upper Saddle River, N.J.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The charge transport layer 240 can have antioxidant in an amount ranging from about 0 to about 20 weight %, from about 1 to about 10 weight %, or from about 3 to about 8 weight % based on the total charge transport layer.

The charge transport layer 386 including charge-transporting molecules or compounds dispersed in an electrically inert polymer can be an insulator to the extent, that the electrostatic charge placed on the charge transport layer 386 is not conducted such that formation and retention of an electrostatic latent image thereon can be prevented. On the other hand, the charge transport layer 386 can be electrically "active" in that it allows the injection of holes from the layer including one or more of nano-carbon materials and organic conjugated polymers in each pixel of the array of hole-injecting pixels 385, and allows these holes to be transported through the charge transport layer 386 itself to enable selective discharge of a negative surface charge on the surface 388.

Any suitable and conventional techniques can be utilized to form and thereafter apply the charge transport layer 386 over the array of pixels 385. For example, the charge transport layer 386 can be formed in a single coating step or in multiple coating steps. These application techniques can include spraying, dip coating, roll coating, wire wound rod coating, ink jet coating, ring coating, gravure, drum coating, and the like.

Drying of the deposited coating can be effected by any suitable conventional technique such as oven drying, infra red radiation drying, air drying and the like. The charge transport layer 386 after drying can have a thickness in the range of about 1 μm to about 50 μm, about 5 μm to about 45 μm, or about 15 μm to about 40 μm, but can also have thickness outside this range.

Amorphous Silicon for fabrication of Transistor arrays in the backplane. Amorphous Silicon can be chosen as the semiconductor material for the fabrication of the transistors. Amorphous Si TFT is used widely as the pixel addressing elements in the display industry for its low cost processing and matured fabrication technology. Amorphous Si TFTs are also suitable for high voltage operations by modifying the transistor geometry (ref: K. S. Karim et al. Microelectronics Journal 35 (2004), 311., H. C. Tuan, Mat. Res. Symp. Proc. 70 (1986).

A latent image forming system 380 using a TFT backplane includes a plurality of TFTs 384 with the source electrodes connected to the substrate 382 and drive the hole injection pixels 385 coupled to a charge transport layer 386 (i.e., a hole transport layer). The system 380 uses TFT control for both electric discharge for surface potential reduction and for latent image formation. A development (printing) electrode can be used to charge or just create an electric field across the charge transport layer 386. The development electrode can be a biased toned mag brush, a biased ink roll, a corotron, scorotron, discorotron, biased charge roll, bias transfer roll and like. For example, direct printing can obtained by bringing the nano imaging member in a nip forming configuration with a bias toned mag roll. The mag roll can be negatively bias with a voltage of −V. Printing can result when the TFT is grounded (V=0) or positive. Under this configuration, an electric field is created between the printing electrode and the hole injection pixel 385. The field induced hole injection and create a positive surface charge on surface 388. The positive charge is then developed resulting in printing. On the other hand, when the TFT is biased like the mag roll (−V), no electric field is created. Consequently no surface charge is created in surface 388 and no printing is resulted.

FIG. 3(*b*) illustrates an embodiment of a nano digital direct printing system according to the invention. The nano digital direct printing system includes a controller 305, a nano imaging member 310, a development subsystem 320 and a transfer/fuser subsystem 325. The controller 305 transmits digital printing data to an antenna/receiver coupled to the nano imaging member 310. The controller 305 transmits the digital printing data wirelessly to the antenna/receiver coupled to the nano imaging member 310. Illustratively, the controller 305 may transmit the printing data via a Wireless Display (WiDi) protocol.

The nano imaging member 310 receives the printing signals from the antenna/receiver and converts the printing signals into an electrostatic latent image. More specifically, an antenna/receiver on the nano imaging member receives the printing signals and converts the printing signal to analog signals, which control the driving electronics to drive the multitude of TFTs in the backplane of the nano imaging member. The TFTs in turn will address the hole injection pixels of the imaging member individually thus creating a digital electric field across the nano imaging member when contacting the development subsystem 320. The electrostatic latent image can be formed during the contact and be developed or printed. Suitable printing materials are dry powder xerographic toner, liquid toner, flexo inks, offset inks or other low viscosity inks. The transfer/fuser subsystem 325 receives the image and transfers the image onto a media. The image can then be fixed on the media by heat, pressure and/or UV radiation depending on the imaging material used.

The transmission path between the controller and the antenna/receiver should be free of obstacles. In addition, certain electromagnetic shielding may need to be installed within the printing device to minimize interference with the wirelessly transmitted printing data. The antenna/receiver may be on one integrated circuit. Alternatively, the antenna may be on one integrated circuit and the receiver may be on a separate integrated circuit.

Still referring to FIG. 3(*b*), in alternative embodiments, the nano imaging member 310 may be divided into a plurality of zones. The nano imaging member may be divided into zones because the controller 305 may not be able to transmit the digital print data signals to the entire nano imaging member 310 at one time. In the embodiment of the invention illustrated in FIG. 3(*b*), the nano imaging member 310 is divided into eight zones, labeled by the reference numbers 1-8. In embodiments of the invention, the nano imaging member 310 may be divided into two zones, three zones, four zones or sixteen zones. The zones should be equal in size (or geometric area). Thus, if there are eight zones, the eight zones may be equal in size or area with respect to each other.

In embodiments, each zone of the nano imaging member 310 may include an antenna/receiver to receive the printing signals from the controller 305. Illustratively, if the nano imaging member has eight zones, the nano imaging member 310 may have eight antenna/receivers. In further alternative embodiments, each zone may include a plurality of antenna/receivers. Each zone may correspond to a part of the image that will be transferred and fixed onto the media being transported through the printer. In embodiments of the invention, only one zone of the nano imaging member may have an antenna/receiver. In this embodiment, the zone's antenna/receiver receives the wirelessly transmitted data and transfers the received data to the zone of the nano imaging member that is selected.

FIG. 3(*c*) presents a cross section view of a nano imaging member according to an embodiment of the invention. FIG. 3(*d*) presents a top view of the nano imaging member according to an embodiment of the invention. Referring to FIG. 3(*c*), the nano imaging member 310 includes a substrate 360, an antenna/receiver 362, driving electronics 364, a plurality of thin-film transistors (TFTs) that form a TFT array 365, a plurality of hole injection pixels 368, and a charge transport layer 370. The antenna/receiver 362 may be installed on a board or substrate with the driving electronics 364. Alternatively, the antenna/receiver 362 may be located on a separate integrated circuit from the driving electronics 364, as is illustrated in FIG. 3(*c*).

Figure 4:
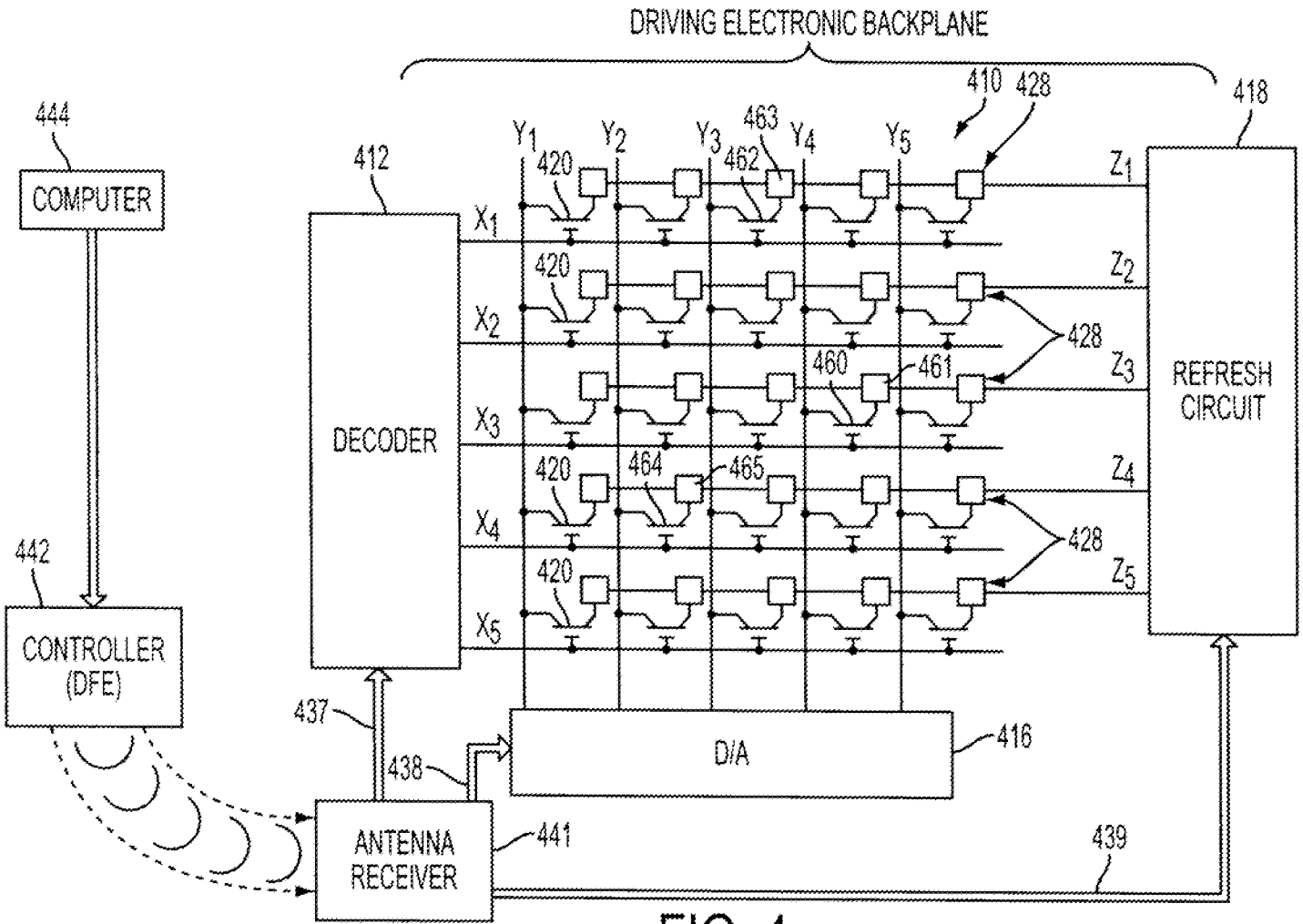
FIG. 4 illustrates the nanoimaging member in a printing device according to an embodiment.

FIG. 4 illustrates an array of thin film transistors in the apparatus for forming a latent image or direct printing according to an embodiment of the invention. As shown, FIG. 4 illustrates a TFT array 410 arranged in a rectangular matrix of 5 rows and 5 columns. The TFT array 410 generates latent images from digital information supplied by a computer 444 to a controller 442. In an embodiment of the invention, the computer 444 transmits the digital print file to the controller or digital front end (DFE) 442. The controller 442 will decompose the digital signal into CMYK or RGB bits and then wirelessly transmits the digital bits to an antenna/receiver 441. The antenna/receiver 441 transfers the received digital information to the TFT array 410 and this information includes pixel locations and pixel voltages. In embodiments of the invention, the controller 442 controls/directs the operation of the TFT array 410 wirelessly, by transmitting the digital information to the antenna/receiver 441 and running a plurality of interface devices, including the decoder 412, a refresh circuit 418, and a digital-to-analog (D/A) converter 416. The decoder 412, refresh circuit 418 and D/A converter 416 may be referred to as the driving electronic.

After receiving the digital signals from the antenna/receiver 441, the decoder 412 generates signals that select individual pixel cells in array 410 by their row and column locations to produce a latent image. Illustratively, the controller 442 transmits signals to the antenna/receiver wirelessly and the antenna/receiver 441 transfers the information to the decoder 412 via bus 437. In this embodiment, the controller 442 generates digitized pixel voltage and location information and transmits the digitized pixel voltages wirelessly to the antenna/receiver which include digital to analog (D/A) converter 416 via bus 438. The D/A converter 416 convert the digitized pixel voltages to analog voltages which are placed on the selected column or columns Y1-Y5. In order to refresh the nano imaging member, the controller 442 transmits address data wirelessly through the antenna/receiver 441 and then to the refresh circuit 418 via bus 439 to select rows Z1-Z5. The refresh circuit 418 operates in a fashion similar to memory refresh circuits used to recharge capacitors in dynamic random access memories (DRAMs).

In embodiments of the invention, the operating bias voltage for the TFT array 410 may range from +20 Volts to −200 Volts. In alternative embodiments of the invention, the operating bias voltage for the TFT array 410 may range from +100 to −400 Volts. In embodiments of the invention, the pixel size may range from 10 micron×10 micron to 30 micron by 30 micron. In other embodiments of the invention, pixel size may range from 1 micron×1 micron to 200 micron by 200 micron.

In the embodiment illustrated in FIG. 4, each pixel pad 428 is connected to a thin film transistor 420 and includes a capacitor in contact with a hole injection pixel. Semiconductor materials, such as amorphous silicon (a-Si:H), are well suited to the desired operational and fabrication characteristics of the transistors. In view of the relatively inexpensive fabrication costs of both active and passive thin film devices over large area formats (for example, upon Aluminum, stainless steel, glass, polyimide, or other suitable substrates), it is possible to provide a cost effective TFT array 410. Furthermore, the TFT array 410 may incorporate high voltage thin film transistors 420 on the same integrated circuit as the high voltage capacitors and decoder 412.

Operation of illustrated portions of the array 410 is as follows. The computer 444 supplies digital image information to the TFT array 410 via the driving electronics. Still referring to FIG. 4, the computer sends the digital print to the digital front end (or controller) 442 which converts the digital print into CMYK or RGB color bits. Controller 442 then sends this digital information wirelessly to the antenna/receiver 441 which is part of the driving electronics. The digital signals will have information about the pixels location and bias voltage, (e.g., at the intersection of 1) row $X_3$ and column $Y_4$; 2) row $X_4$ and column $Y_2$; and 3) row $X_1$ and column $Y_3$) should be charged to form a portion of an image. Illustratively, the controller 442 transmits a code of binary digits from to select the rows to charge the pixels $X_3Y_4$, $X_4Y_2$, and $X_1Y_3$. In the embodiment of FIG. 4, the antenna/receiver 441 in the driving electronics receives the transmitted code of binary digits and applies a gate bias voltage to the transistors 420 on rows $X_3$, $X_4$ and $X_1$. The controller 442 transmits the digitized pixel voltages to the antenna/receiver 441 which transfers the digitized pixel voltages to the D/A converter 416. The D/A converter 416 produces an analog output corresponding to the value of the digital input and places the analog output on the source electrodes of the high voltage transistors connected to columns $Y_4$, $Y_2$ and $Y_3$. As shown in FIG. 4, only three of the transistors, generally indicated by the reference numerals 460, 462, and 464 is turned ON by the combination of the $X_3$ gate bias voltage and the voltage on column $Y_4$; the combination of the $X_4$ gate bias voltage and the voltage on column $Y_2$, and the combination of the $X_1$ gate bias voltage and the voltage on column $Y_3$. Therefore, the analog voltage only appears at the drain of transistor 460, 462 and 464 and charges the high voltage capacitor contained in the pixel pad indicated by reference numeral 461, 463 and 465. This process is repeated for each subsequent pixel that is addressed until the desired latent image is produced. Over time the capacitors will begin to discharge. To preserve their charge, each pixel cell must be refreshed by the refresh circuit 418.

It will be appreciated that several of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. A method of forming an electrostatic latent image, comprising:

receiving, at a receiver, wirelessly transmitted digital printing signals from a print engine;

transmitting, from a transmitter, driving signals to address individual thin-film transistors (TFTs) in a TFT array in response to the received digital printing signals; and transmitting, from a transmitter, pixel voltages to bias individual TFTs in the TFT array to generate the electrostatic latent image in response to the received digital printing signals.

2. The method of claim 1, further including converting the electrostatic image into an image that is printed on a media.

3. The method of claim 1, wherein creating the electrostatic latent image further comprises applying an electrical bias to one or more pixels via the individual TFTs in the TFT array to either enable hole injection or disable hole injection at the interface of the one or more pixels and the charge transport layer.

4. The method of claim 1 further including receiving the electrostatic latent image at the development subsystem and converting the electrostatic latent image into a toner image.

5. The method of claim 4, further including receiving the toner image, transferring the toner image onto a media, and fixing the toner image onto the media.

6. The method of claim 4, the toned image include images made from dry powder toner, liquid toner, offset inks, flexo inks and other low velocity inks.

7. The method of claim 1, wherein the received digital signals were transmitted according to the WiDi wireless protocol.

8. An apparatus for printing a latent image comprising:

a receiver and a transmitter, coupled to the driving electronics, and configured to receive wirelessly transmitted digital signals from a print engine, to generate selection signals and digital pixel voltages, the transmitter to transmit the selection signals and digital pixel voltages;

driving electronics configured to receive the selection signals and the digital pixel voltages and to generate bias signals and pixel voltages; and a plurality of thin-film transistors (TFTs) arranged in a TFT array to receive the bias signals and the pixel voltages and to generate an electrostatic latent image in response to the bias signals and pixel voltages.

9. The apparatus of claim 8, further including an antenna, located on the nano imaging member, configured to receive the wirelessly transmitted signals from the print engine and to transfer the received digital signals to the receiver.

10. The apparatus of claim 8, wherein the receiver is a wireless display protocol (WiDi) receiver.

11. The apparatus of claim 8, wherein the TFT array is comprised of an array of pixels disposed over a substrate and a charge transport layer disposed over the array of pixels, wherein each pixel of the array of pixels is electrically isolated, individually addressable and comprises a layer of one or more nano-carbon materials.

12. The apparatus of claim 8, wherein the TFT array is divided into a plurality of zones and each of the plurality of zones includes a corresponding receiver to receive the wirelessly transmitted digital signals from the print engine and to generate corresponding selection signals and digital pixel voltages.

13. The apparatus of claim 8, wherein the backplane is divided into a plurality of zones and one of the plurality of zones includes the receiver and wherein the receiver transfers the received selection signals and digital pixel voltages to a selected zone of the plurality of zones.

14. The apparatus according to claim 13, further including a transfuser system configured to receive the toner image, transfer and fuse the toner image onto a media.

15. The apparatus of claim 13, the toned image include images made from dry powder toner, liquid toner, offset inks, flexo inks and other low velocity inks.

16. The apparatus of claim 8, wherein the TFT array is configured to be connected to a rotating drum and further including a development subsystem configured to convert the electrostatic latent image to a toner image.

17. A printing device, comprising:

a print engine configured to receive image signals from an external device and to generate digital signals corresponding to the image signals;

a wireless transmitter configured to transmit the digital signals received from the print engine;

a wireless receiver and transmitter, coupled to driving electronics, and configured to receive the digital signals, to generate selection signals and digital pixel voltages, and to transfer the generated selection signals and digital pixel voltages; and the driving electronics to receive the generated selection signals and digital pixel voltages, and to generate control signals and pixel voltages to bias individual thin field transistors (TFTs) in a TFT array to generate a latent electrostatic image.

18. The printing device according to claim 17, wherein the wireless transmitter and the wireless receiver are configured to operate utilizing the wireless display (WiDi) protocol.

19. The printing device according to claim 17, wherein the TFT array is comprised of an array of pixels disposed over a substrate and a charge transport layer disposed over the array of pixels, wherein each pixel of the array of pixels is electrically isolated, individually addressable and comprises a layer of one or more nano-carbon materials.

20. The printing device according to claim 19, further including a digital-to-analog converter configured to receive the pixel voltages, generate analog voltages and apply the analog voltages to selected TFTs within the TFT array.

21. The printing device according to claim 17, wherein the TFT array is divided into a plurality of zones, and each of the plurality of zones includes a corresponding wireless receiver configured to receive the digital signals and to transfer the digital signals to the controller.

22. The printing device according to claim 17, wherein the backplane is divided into a plurality of zones and one of the plurality of zones includes the receiver and wherein the receiver transfers the received selection signals and digital pixel voltages to a selected zone of the plurality of zones.

23. The printing device according to claim 17, further including a decoder configured to receive the control signals from the controller and to apply bias voltages to selected rows of the TFT array based on the received control signals.

24. The printing device according to claim 17, the TFT array connected to a rotating drum and further including a development subsystem configured to convert the electrostatic latent image to a toner image and a transfuser system configured to receive the toner image, transfer and fuse the toner image onto a media.

* * * * *